United States Patent [19]

Redovian

[11] 4,385,572

[45] May 31, 1983

[54] DROP-IN PATTERN STITCH ASSEMBLY FOR A STRAIGHT STITCH SEWING MACHINE

[76] Inventor: Martin Redovian, 1185 Sierra Vista Way, Lafayette, Calif. 94545

[21] Appl. No.: 231,045

[22] Filed: Feb. 2, 1981

[51] Int. Cl.[3] ..... D05B 3/02

[52] U.S. Cl. ..... 112/158 R; 112/168; 112/262.1

[58] Field of Search ..... 112/168, 158 A, 158 D, 112/158 R, 315, 262.1

[56] References Cited

U.S. PATENT DOCUMENTS

| | | | |
|---|---|---|---|
| 2,854,935 | 10/1958 | Benink et al. | 112/158 D |
| 3,005,427 | 10/1961 | Engel | 112/158 R |
| 3,177,835 | 4/1965 | Tanaka et al. | 112/158 A |
| 3,242,890 | 3/1966 | Fresard | 112/158 R |
| 3,724,282 | 4/1973 | Daman | 112/158 A |

*Primary Examiner*—Werner H. Schroeder
*Assistant Examiner*—Andrew M. Falik
*Attorney, Agent, or Firm*—Bruce & McCoy

[57] ABSTRACT

A drop-in pattern stitch assembly for a straight stitch sewing machine comprised of a first drop-in cam drive sub-assembly located at and driven from the forward end of the machine's existing horizontal drive shaft for controlling the lateral zig-zag motion of the machine's needle bar, and a second drop-in cam drive sub-assembly located at and driven from the rearward portion of the horizontal drive shaft for controlling the rotational action of the machine's feed fork regulator, for, in turn, regulating the action of the machine's feed rock unit which moves material on the machine's needle plate. It is contemplated that a standard straight stitch sewing machine can be easily upgraded, first to a simply zig-zag sewing machine, and thereafter to more complex pattern machines, by installation of appropriate drop-in cam drive sub-assemblies of the invention. A special pattern cam belt is adapted for installment between the two in place cam drive sub-assemblies of the invention.

20 Claims, 8 Drawing Figures

DROP-IN PATTERN STITCH ASSEMBLY FOR A STRAIGHT STITCH SEWING MACHINE

BACKGROUND OF THE INVENTION

The present invention relates to sewing machines generally, and more particularly to the pattern control mechanisms of sewing machines which control the motion of the stitching needle and the material for the purpose of generating stitch patterns ranging from simple zig-zag patterns to complex ornamental patterns.

To provide different stitch pattern functions, commercially available sewing machines have relatively complex arrangements of cams, linkages, levels and cranks to reciprocate and oscillate the machine's needle bar, and to control the movement of the material feed dog found beneath the needle plate in the base of the machine. A purchaser of a sewing machine will normally chose a machine which meets his or her experience level and needs: a beginner sewer will likely choose a simple straight stitch machine with only straight stitch capability; a sewer with some experience may wish to purchase the additional versatility found in a simple zig-zag machine while more advanced sewers would likely want to expand to more complex commercially available machines with complex stitch width and stitch length control as provided by, for example, pattern selector knobs and/or drop in pattern discs. To upgrade equipment a sewer will normally have to buy a new machine, since the construction and complexity of most sewing machines economically preclude taking, for example, a straight stitch machine and upgrading it to a more complex ornamental pattern stitch machine.

It is a primary object of the present invention to provide a sewing machine which is greatly simplified in construction as compared to conventional equipment and which is upgradable from a straight stitch machine to a machine capable of handling very complex pattern stitches. Still other objects of the invention will become apparent from the following specification and claims.

SUMMARY OF THE INVENTION

The invention is a drop-in pattern stitch assembly for a sewing machine. The invention is essentially comprised of separate first and second drop-in cams drive sub-assemblies removably secured within the top portion of the machine frame proximate to, respectively, the forward end and rearward end of the sewing machine's existing, in-place horizontal drive shaft. The first cam drive sub-assembly regulates the lateral oscillatory movement of the needle bar and is comprised of a first rotatable cam means having a pattern control surface thereon, and means for rotatably driving the first cam means from the forward end of the horizontal drive shaft. A first cam follower means is provided in the machine for oscillating the needle bar in correspondence to the pattern surface of the first cam means. The second drop-in cam drive sub-assembly regulates the longitudinal action of the feed rock unit of the sewing machine for controlling stitch length and direction. The second drop-in cam drive assembly is comprised of a second rotatable cam means and means for driving same from the rearward portion of the horizontal shaft. It is also comprised of a second cam follower means for controlling the movement of the machine's feed fork regulator in correspondence with the pattern surface on the second cam means.

In the preferred embodiment on the invention it is contemplated that the first and second cam means will be interchangeable cam discs having their pattern surfaces formed, respectively, on the upper and lower flat disc surfaces thereof, and that the cam discs will be disposed in a common horizontal plane. It is further contemplated that a separate cam belt having two cam surfaces, one on the upper belt edge and one on the lower belt edge, can be stretched around the cam discs for providing from a single belt an extended cam surface for both stitch width and stitch length control.

It will be seen that the objects of the invention will be achieved, in part, by physical separation in the machine of the stitch width and stitch length control functions, and by a construction which permits easy retrofitting.

DETAILED DESCRIPTION OF THE PREFERRED EMBODIMENT

Figure 1:
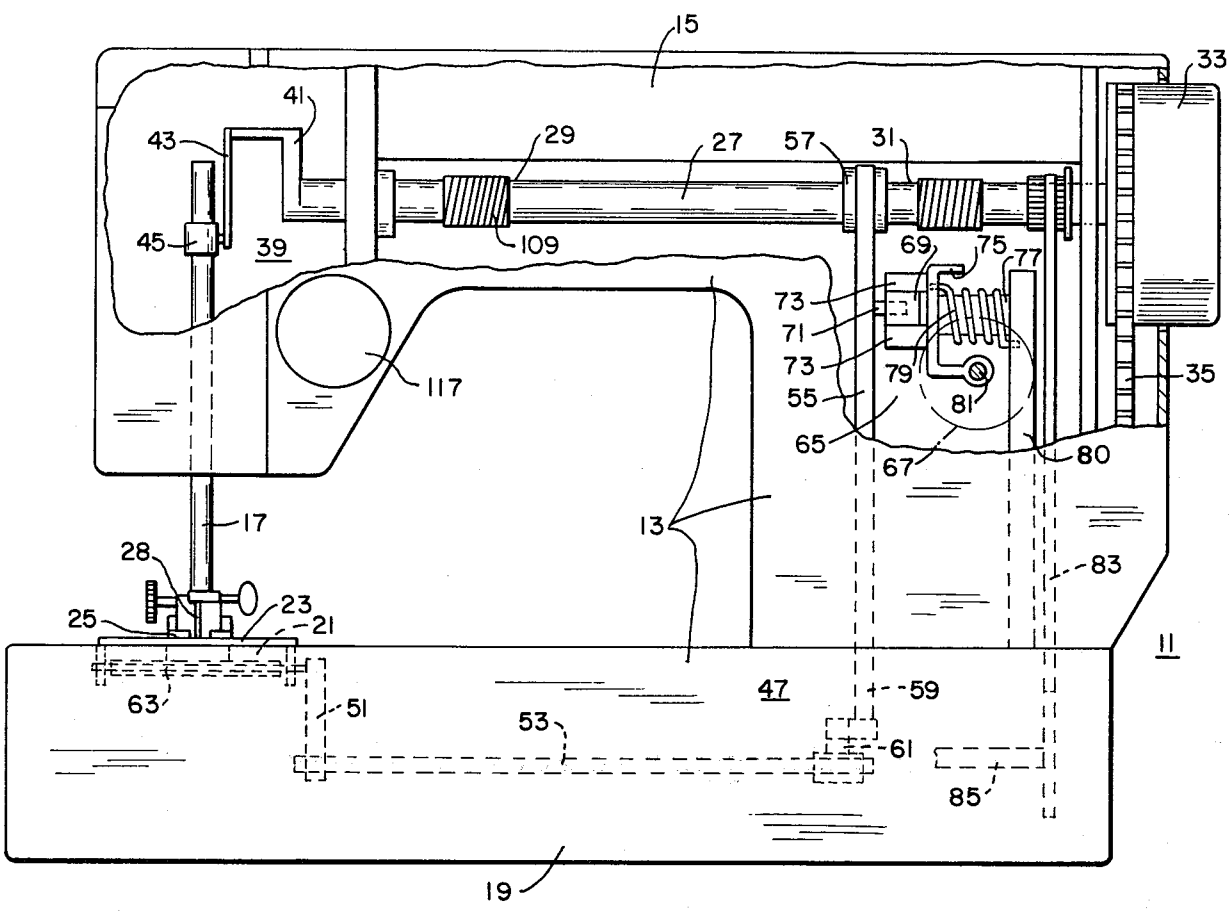
FIG. 1 is a partially cut away side elevational view of a basic straight stitch sewing machine which can be upgraded to a more complex machine in accordance with the present invention.

Referring now to the drawings, FIG. 1 shows a basic straight-stitch sewing machine, generally denoted 11, including the essential drive and control elements utilized by the invention. Removed from the FIG. 1 machine because they are not required by the invention are numerous linkages, levers and cams normally found in commercially available machines.

With further reference to FIG. 1, it can be seen that the machine 11 has a machine frame 13 generally consisting of a top portion 15, which houses the drive and control mechanisms for the needle bar 17, and a base portion 19, which houses the drive and control mechanisms for the feed rock unit 21. In a long used and well-known machine manipulation, the sewing needle 28 held at the end of reciprocating needle bar 17 stitches material as the material is longitudinally moved forward over the needle plate 23 under the pressure foot 25 by the feed dog (not shown) of the feed rock unit 21. In the basic straight stitch machine only the stitch length is adjusted, this by manually adjusting the length of the stroke of the feed dog. In a zig-zag machine, lateral oscillating motion is imparted to the needle bar 17 to produce zig-zag sewing patterns. In deluxe machine types, stitch length control and reverse action stitches are provided by controlling the action of the feed dog for controlling the movement of the material on the needle plate.

The basic drive of the sewing machine 11 is provided by a horizontal drive shaft 27 which extends through the top portion 15 of the machine frame 13; the drive shaft 27 can generally be defined as having a forward end 29 located relatively close to the needle bar 17, and a rearward end 31 located generally over the feed fork 55 of the feed rock drive assembly 47. The rearward end of the drive shaft 27 is terminated by a balance wheel 33, and drive power is supplied to the balance wheel through the drive belt 35 by a drive motor 34.

A needle bar reciprocating mechanism 39 converts the rotational motion of the horizontal shaft 27 to translational motion in the needle bar 17. This mechanism is shown as being comprised of a crank 41 and connecting link 43 extending for attachment to a needle bar collar 45. A slip connection between the connecting link and needle bar will allow the needle bar to be laterally oscillated for zig-zag operation.

The feed rock unit 21 located in the base portion of the machine, together with its feed dog which projects up through the needle plate 23, is driven in a back and forth and up and down pumping movement. This is done through a feed rock drive assembly 47 interconnected to the horizontal drive shaft 27. The feed rock drive assembly generally consists of a feed drive shaft 85 and synchronizing belt 83 (for alternatingly raising and lowering the feed rock unit), and a feed rock shaft crank 51, oscillating shaft 53, and feed fork 55, which together longitudinally reciprocate the feed rock unit and which therefore control stitch length. The stitch length control portion of the feed rock drive assembly operates off of feed cam 57 on the horizontal drive shaft 27 as follows: The feed cam acts to oscillate the feed fork 55 in lateral motion which will have an axial component determined by the adjustment of the feed regulator 65. By means of feed fork crank 61 attached to the feed fork end 59 any axial motion in the feed fork is translated into rotational motion of the oscillating shaft 53. The rotational motion of the oscillating shaft 53 in turn, moves the feed rock unit back and forth by means of crank 51 connected to the feed rock shaft 63.

The conventional feed fork regulator 65 is shown as being disposed generally in the top portion of the machine frame behind the feed fork 55, and as having a feed fork regulator slide block 69, which is attached to the upper end of the feed fork 55 by means of laterally projecting post 71. The slide block 69 is constrained to move between two feed regulator guide walls 73, which are secured to a bracket 75 adapted to rotate on a mounting post 77 anchored to a suitable internal wall support 80. The guide block assembly consisting of slide block 69, guide walls 73, and bracket 75 are spring biased to a desired rotational position on the mounting post by means of coil spring 79. To vary the stitch length the angulation of the guide walls 73 of the feed regulator are varied whereby the axial component of motion of the slide block 71 and the feed fork is varied. For example, if the guide walls 73 are positioned horizontally, there will be no axial component of motion in the feed fork and hence there will be no stitch length motion transmitted through the feed rock drive assembly. This position defines a zero stitch length between a forward action and reverse action in the machine.

Figure 5:
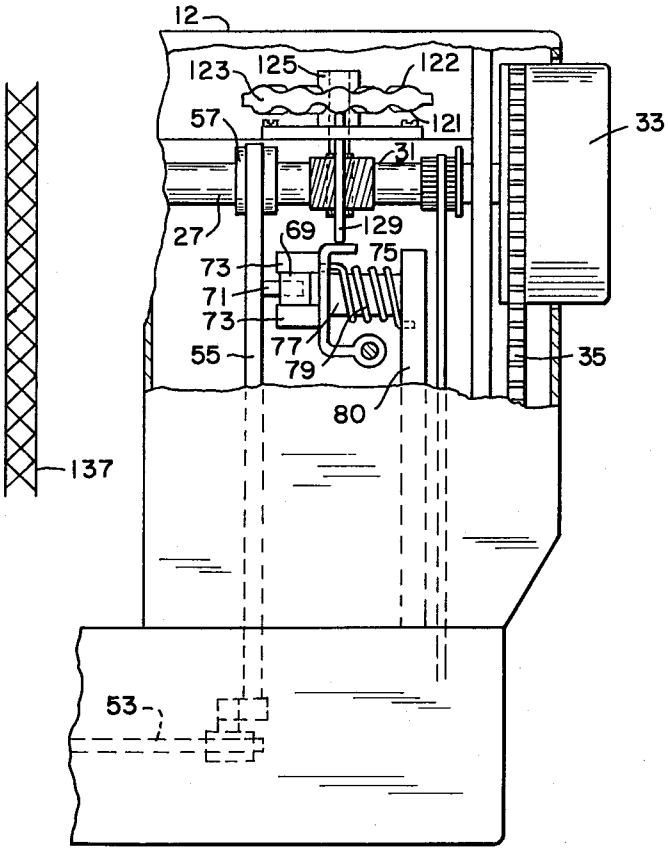
FIG. 5 is partially cut-away partial side elevational view of the rearward portion of the sewing machine shown in FIG. 1 with the addition of a drop-in cam drive sub-assembly for regulating a movement of the feed fork regulator, and hence the action of the feed dog beneath the needle plate.

It can be seen with reference to FIG. 1 and FIG. 5 that the angulation of the guide walls 73 are adjusted by adjustment of the rotational position of the feed regulator bracket 75, and that this bracket position is manually adjusted by external knob 67.

Figure 6:
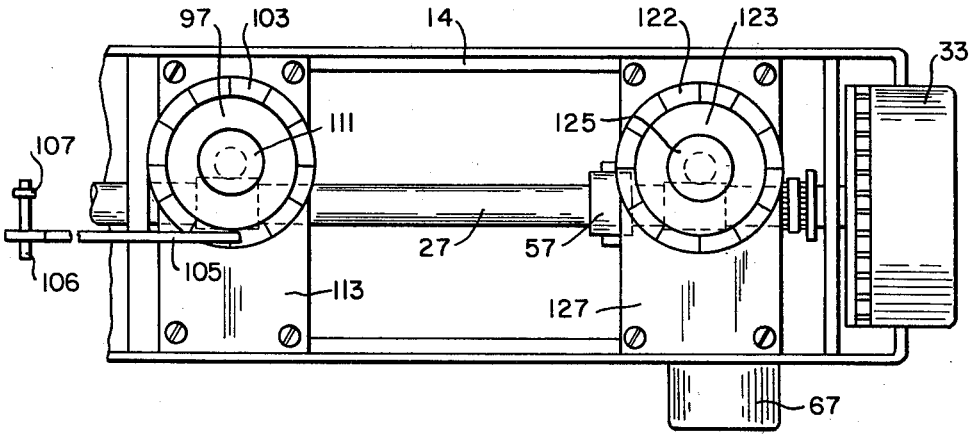
FIG. 6 is a top plan view of the sewing machine shown in FIG. 1 with the top cover removed and with the addition of the drop-in cam drive sub-assemblies shown in FIGS. 4 and 5.
Figure 7:
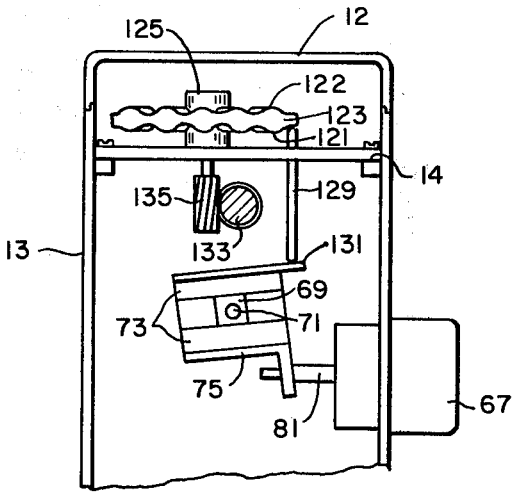
FIG. 7 is a partial cut-away end elevational view of the sewing machine shown in FIG. 6 illustrating the drop-in cam drive sub-assembly shown in FIG. 5 and the feed fork regulator of the machine.
Figure 8:
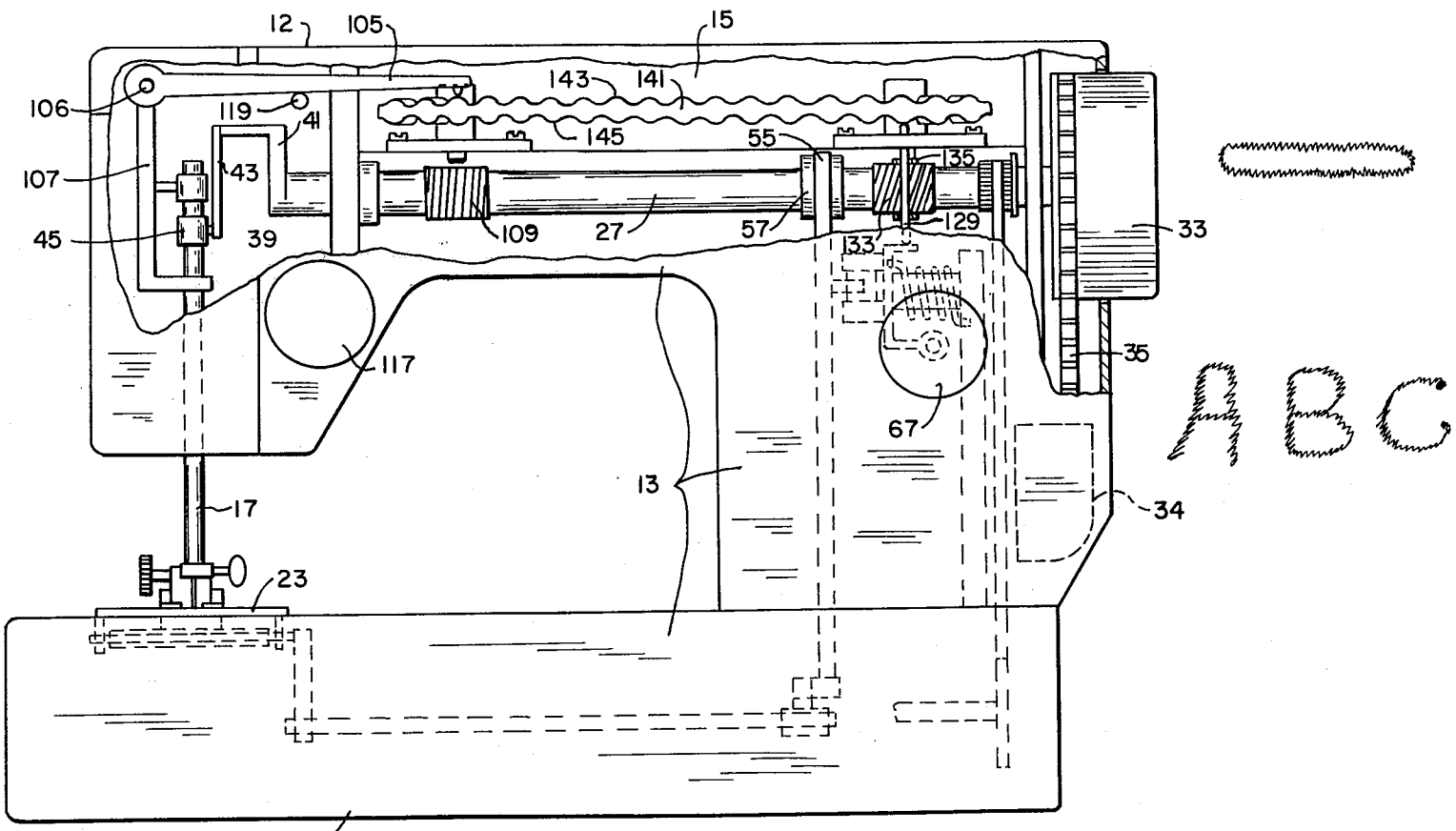
FIG. 8 is a partially cut-away side elevational view of a sewing machine, showing the use of a cam belt in connection with the two drop-in cam drive sub-assemblies shown in FIGS. 4–7.

Referring generally to FIGS. 2–8, different drop-in cam drive sub-assemblies are shown which provide different machine stitch pattern capabilities, from a simple zig-zag (FIGS. 2 and 3), to extended zig-zag patterns (FIG. 4), to stitch length and reverse action control (FIGS. 5–7), and finally to a cam belt control for complex, long cycle stitch patterns (FIG. 8). It is seen that the stitch width pattern control is preferably transmitted to needle bar 17 through a permanently installed first cam follower means comprised of horizontally extending cam follower bar 105 and the needle bar support 107 pivotally connected to the cam follower bar 105.

For zig-zag or stitch width control there is generally provided a separate first cam drive sub-assembly removeably disposed in the top portion 15 of the machine frame 13 proximate the forward end 29 of the horizontal shaft 27 between the horizontal shaft and the existing, in-place cam follower bar 105. It is noted that the forward position of this separate sub-assembly minimizes the linkage distance between the assembly's control cam and the needle bar 17. The illustrated cam means of the first cam drive sub-assembly includes a split cam 95 shown in FIGS. 2–3, and a drop-in cam disc shown in FIGS. 4–8. In the case of the split cam 95, the pattern control surface is defined by the perimeter 101 of the cam; in the case of the cam disc the pattern control surface is defined by the pattern surface 103 formed on the flat surfaces of the disc.

Figure 2:
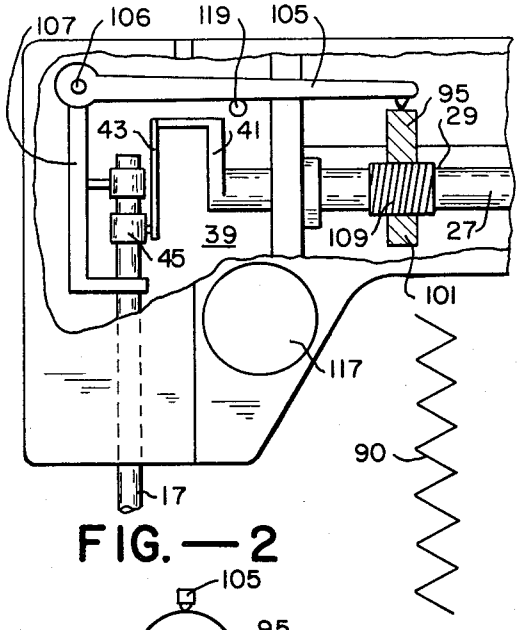
FIG. 2 is a partially cut away partial side elevational view of the front of the sewing machine shown in FIG. 1, with the addition of a simple drop-in cam mechanism for producing a simple cam controlled zig-zag pattern.
Figure 3:
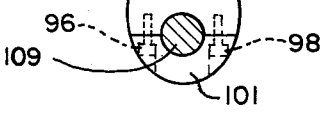
FIG. 3 is a cut away view of the zig-zag control cam of FIG. 2.
Figure 4:
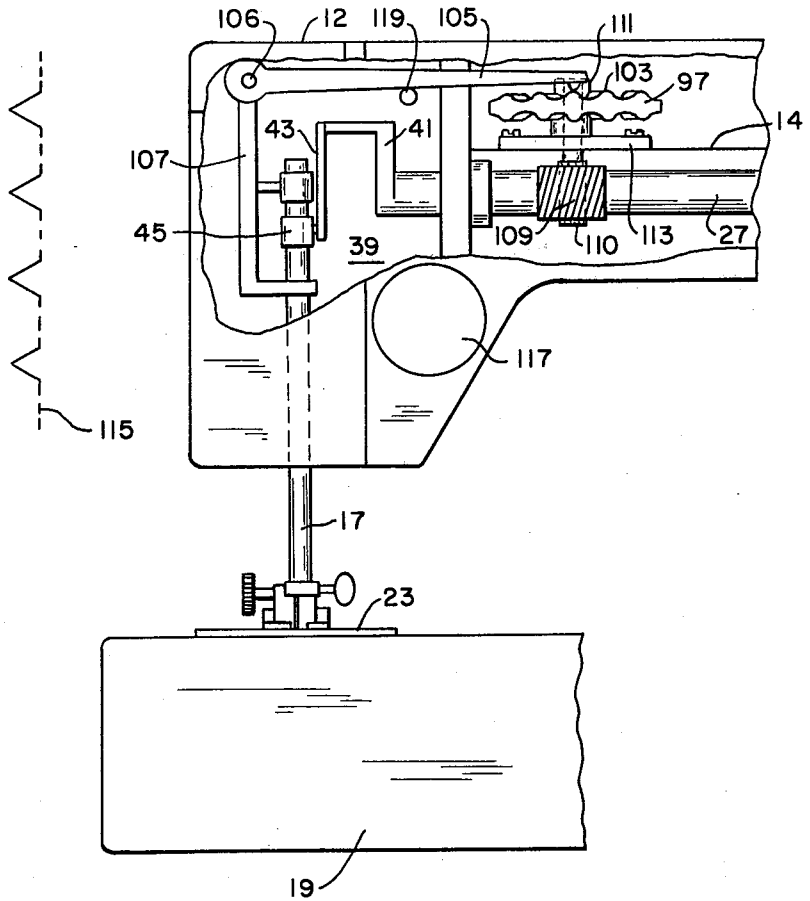
FIG. 4 is a partial elevational view of the forward portion of the sewing machine shown in FIG. 1 with the addition of a drop-in cam drive sub-assembly for producing relatively complex zig-zag patterns.

Referring to FIGS. 2 and 3 it is seen that split cam means is clamped onto horizontal shaft 27 by socket head set screws 96, 98 over an existing worm gear 109 on the forward end 29 of the horizontal shaft; the worm gear 109 is used in the upgraded version of FIG. 4 to drive the cam disc 97 and can be protected by an elastomeric liner in the center bore of the cam. The split cam 95 produces the conventional zig-zag pattern 90 shown in FIG. 2.

In the more complex first drop-in cam drive sub-assembly illustrated in FIGS. 4 and 5, cam disc 97 is interchangeably secured to a first cam drive post 111, which is journalled to a first drop-in mounting plate 113 and driven from the horizontal shaft 27 by worm gears 109, 110. It can readily be seen that the first drop-in cam drive sub-assembly formed by the cam disc 97, drive post 111, and mounting plate 113 can be easily inserted in the forward end of the machine frame at such time as the user desires to have the machine converted from a straight stitch or zig-zag machine into a machine having a more complex zig-zag pattern capability. This conversion is achieved by simply removing the top cover 12 of the machine, inserting the sub-assembly beneath the cam follower bar 105 to engage the worm gears 109 and 110 of the drive post 111 and horizontal shaft 27, and securing the mounting plate to opposing shoulder surfaces 14 formed in the sides of the machine frame. The pattern surface 103 of the cam disc 97 is formed generally about the perimeter of the cam disc, and therefore the cam follower bar 105 is shown as being positioned laterally of the axis of drive post 111 such that the end of the cam follower bar rides on the cam surface. Necessary lateral adjustment of the cam follower bar 105 can be provided for by, for example, lateral adjustment along a laterally extending cam follower bar axis 106 (see FIG. 6). The many zig-zag patterns that can be generated by the drop-in disc assembly of FIG. 4 include the illustrated blind hem stitch 115.

It is noted that zig-zag amplitude adjustment is provided by means of a conventionally positioned external adjustment knob 117 which adjustably locates a stop 119 underneath the follower bar 105 so as to limit the maximum excursion of the follower bar.

The invention provides further upgrading of the basic machine shown in FIG. 1 by means of the second drop-in cam drive sub-assembly illustrated in FIGS. 5, 6, and 7, which acts to control stitch length separately from the stitch width control of the first cam drive sub-assembly above-described. The second drop-in cam drive sub-assembly is removably disposed in the top portion 15 of the machine frame 13 proximate the rearward end 31 of the horizontal drive shaft 27 and above the feed fork regulator 65. The control cam means of this sub-assembly, like the first stitch width control cam means, is positioned to minimize necessary linkage parts and distances between cooperating parts. In the illustrated embodiment the second drop-in cam drive sub-assembly is comprised of a second cam means in the form of cam disc 123 interchangeably secured to second drive post 125 journalled to a mounting plate 127 which is secured to the opposing shoulders surfaces 14 of the machine frame 13. Cam disc 123 is rotated by the horizontal shaft 27 through worm gears 133, 135. The second cam follower means, which is preferably an installed part and therefore forms part of the second cam drive sub-assembly, consists of a cam follower rod 129 extending downwardly from the lower cam surface 121 of disc 123 to a right angled tab 131 of the feed regulator bracket 75. Thus, it can be seen that the cam follower rod 129 controls the rotational position of the feed regulator in accordance with the pattern surface 121 on the underside of the cam disc 123, and therefore that the pattern surface 21 on the cam disc 123 will act to regulate the stitch length by overriding the stitch length control knob 67. The stitch length control provided by this second drop-in cam drive sub-assembly enables the user to generate still more complex stitch patterns, such as the overlock stitch pattern 137 illustrated in FIG. 5.

The first and second cam drive posts 111, 125 shown in FIGS. 4 and 5 are shown as extending vertically upwardly from the horizontal drive shaft such that their two respective cam discs 97, 123 lie in a common horizontal plane just beneath the top cover 12 of the machine frame 13. With this preferred construction, the interchangeable cam belt 141 shown in FIG. 8 can be installed in the machine to still further extend and upgrade the machine's pattern stitch capability.

Referring to FIG. 8, cam belt 141, which has two cam surfaces 143, 145, one along the top edge of the cam belt (cam surface 143) and one on the bottom edge of the cam belt (cam surface 145), is stretched around the two existing, in place, co-planar cam discs 97, 123. With the cam belt in place the cam follower bar 105 for controlling the lateral movement of the needle bar will be in a position to follow the top cam surface 123, and the stitch length cam follower rod 129 of the second cam drive sub-assembly will be positioned to follow the bottom cam surface of the cam belt. The cam belt can be used to produce complex stitch patterns, such as button holes and embroidery patterns, requiring an cycle substantially greater than can be provided by a cam disc alone.

With further reference to FIG. 8 it is noted that, with a variety of interchangeable drop-in cam discs and cam belts, the user will have a large variety of pattern stitches to choose from.

Therefore, it can be seen that the present invention provides a drop-in pattern stitch assembly comprised of two separate sub-assemblies so constructed and positioned to greatly simplify the internal construction of a sewing machine. The invention makes the sewing machine more serviceable, and importantly, enables a user to upgrade a machine from a simple straight stitch sewing machine, to a zig-zag sewing machine, to an even more complex pattern stitch sewing machine. Such upgrading in machine capability is achieved by the adding the above-described drop-in sub-assemblies to the machine in the combinations dictated by the complexity desired.

Specifically it can be seen that a straight stitch machine 11, as shown in FIG. 1, having minimal moving parts, can be upgraded to a zig-zag machine by simply installing the split cam 95 around the worm gear 109 located at the forward end 29 of the horizontal drive shaft 27. The machine can later be upgraded to the next level of complexity by removing the split cam 95 and installing the first cam drive assembly shown in FIG. 4, wherein the stitch width is controlled by the pattern surface 103 of the cam disc 97. From this more complex zig-zag configuration, the sewing machine can be upgraded to the next step involving stitch length control by installing the second cam drive assembly whereby the stitch length is controlled by the bottom cam surface 121 of the second cam disc 123. Finally, the sewing machine can be upgraded still further for the most complex sewing patterns by the simple addition of cam belt 141 as shown in FIG. 8.

Although the present invention as been described in considerable detail in the foregoing specification, it is not intended that the invention be limited to such detail, except as necessitated by the appended claims.

I claim:

1. In a sewing machine comprised of a machine frame having a top portion and a base portion, a horizontal drive shaft having a forward end and a rearward end extending through the top portion of said machine frame, a drive motor for rotating said horizontal drive shaft, a needle bar and a needle bar reciprocating mechanism actuated by said horizontal drive shaft, a needle plate beneath said needle bar, a feed rock unit beneath said needle plate to longitudinally move material placed thereon, a feed rock drive assembly including a feed rock oscillating shaft extending through the base of said machine frame, a cam actuated feed fork for rotating said feed rock oscillating shaft from said horizontal drive shaft, and a feed fork regulator disposed beneath the rearward end of said horizontal drive shaft for adjusting the drive action of said feed fork for, in turn, adjusting the movement of said feed rock unit, a drop-in pattern stitch assembly comprising a first drop-in cam drive sub-assembly removably disposed in the top portion of said machine frame proximate the forward end of said horizontal drive shaft, said first drop-in cam drive sub-assembly including a first rotatable cam means having a pattern control surface thereon, and means for rotatably driving said first cam means from the forward end of said horizontal drive shaft, a first cam follower means disposed in the top portion of said machine frame to follow the pattern surface of said first cam means and regulate the lateral motion of said needle bar in correspondence therewith, and a second drop-in cam drive sub-assembly disposed in the top portion of said machine frame proximate the rearward end of said horizontal drive shaft separate from said first drop-in cam assembly and means for removably mounting same to said machine frame, said second drop-in cam drive sub-assembly including a second rotatable cam means having a pattern surface thereon, means for rotatably driving said second cam means from the rearward end of said horizontal shaft, and a second cam follower means for following the pattern surface of said second cam means and controlling said feed fork regulator in correspondence therewith for, in turn, regulating the longitudinal action of said feed rock unit.

2. The drop-in pattern stitch assembly of claim 1 wherein said means for driving said second cam means includes a cam drive post extending perpendicularly from rearward end of said horizontal drive shaft.

3. The drop-in pattern stitch assembly of claim 2 wherein said cam drive post is journalled to a drop-in mounting plate removably secured in the top portion of said machine frame.

4. The drop-in pattern stitch assembly of claim 3 wherein said second cam means is a cam disc secured on said cam post.

5. The drop-in pattern stitch assembly of claim 1 wherein said means for driving said first and second cam means include, respectively, first and second cam drive posts extending perpendicularly from, respectively, the forward and rearward ends of said horizontal drive shaft.

6. The drop-in pattern stitch assembly of claim 5 wherein said first and second cam drive posts are journalled to first and second drop-in mounting plates removably securable in the top portion of said machine frame wherein the first and second drop-in cam drive sub-assemblies can easily be installed in the top portion of said machine frame.

7. The drop-in pattern stitch assembly of claim 6 wherein said first and second cam means are cam discs secured respectively, on said first and second cam posts.

8. The drop-in pattern stitch assembly of claim 7 wherein said first and second cam discs have cam surfaces on at least one of their flat disc surfaces generally at the perimeter thereof, and wherein said first and second cam follower means are disposed to contact the cam surfaces of said cam discs.

9. The drop-in pattern stitch assembly of claim 4 or 8 wherein said feed fork regulator includes a guide block assembly having a pair of guide walls rotatably secured relative to said machine frame, a slide block slidably disposed between said guide walls and attached to the shaft of said feed fork, and spring means for adjustably biasing the rotational position of said guide block assembly, and wherein said second cam follower means extends downwardly from said second cam means to the rotatable guide block assembly of said feed regulator to rotate same away from its biased rotational position in conformance to the cam surface on said second cam means.

10. The drop-in pattern stitch assembly of claim 9 wherein there is a cam surface on the downward facing flat disc surface of said second cam disc.

11. The drop-in pattern stitch assembly of claim 10 wherein said second cam follower means is comprised of a substantially straight feed rod extending downwardly from the downwardly facing cam surface of said second cam disc to the guide block assembly of said feed fork regulator.

12. The drop-in pattern stitch assembly of claim 7 wherein said first and second cam drive posts extend in substantially parallel relation from said horizontal drive shaft so that said first and second cam discs are positioned to lie substantially in the same plane.

13. The drop-in pattern stitch assembly of claim 12 wherein said first and second cam drive posts extend substantially vertically upwardly from said horizontal drive shaft.

14. The drop-in pattern stitch assembly of claim 1 wherein said first cam means includes an eccentric split cam disc removably clamped around the forward end of said horizontal shaft whereby said first cam follower means follows the eccentric perimeter thereof to impart lateral motion to said needle bar in a basic zig-zag pattern.

15. In a sewing machine comprised of a machine frame having a top portion and a base portion, a horizontal drive shaft having a forward end and a rearward end extending through the top portion of said machine frame, a drive motor for rotating said horizontal drive shaft, a needle bar and a needle bar reciprocating mechanism actuated by said horizontal drive shaft, a needle plate beneath said needle bar, a feed rock unit beneath said needle plate to longitudinally move material placed thereon, a feed rock drive assembly including a feed rock oscillating shaft extending through the base of said machine frame, a cam actuated feed fork for rotating said feed rock oscillating shaft from said horizontal drive shaft, and a feed fork regulator disposed beneath the rearward end of said horizontal drive shaft for adjusting the drive action of said feed fork for, in turn, adjusting the movement of said feed rock unit, a drop-in pattern stitch assembly comprising a first drop-in cam drive sub-assembly including a first mounting plate adapted to be removably secured in the top portion of said machine frame above the forward end of said horizontal drive shaft, a first cam drive post journalled to said first mounting plate in substantially perpendicular relation to said horizontal drive shaft, a first cam disc secured on said drive post, said first cam disc having a pattern surface formed around the perimeter of the upwardly facing flat disc surface thereof, and gearing means for rotatably driving said first drive post from the forward end of said drive shaft, cam follower means for following the upper pattern surface of the cam disc of said first drop-in cam drive sub-assembly and regulating therefrom the lateral motion of said needle bar, and a second drop-in cam drive sub-assembly including a second mounting plate adapted to be removably secured within the top portion of said machine above the rearward end of said horizontal drive shaft, a second cam drive post journalled to said second mounting plate in substantially perpendicular relation to said horizontal drive shaft and in substantially parallel relation to the first drive post of said first drop-in cam drive sub-assembly, a second cam disc secured on said second drive post in substantially co-planar relation to the first cam disc of said first drop-in cam drive sub-assembly, said second disc cam having a pattern control surface formed around the perimeter of the downwardly facing flat disc surface thereof, gearing means for rotatably driving said second drive post from the rearward end of said horizontal drive shaft, and a feed rod extending from the downwardly facing pattern control surface of said second cam disc to said guide block assembly of said feed fork regulator for rotationally moving same from its biased rotational position in conformance to the downwardly facing cam surface of said second cam disc.

16. The drop-in pattern stitch assembly of claim 12 or 15 further comprising a cam belt stretched around and driven by said first and second co-planar cam discs, said cam belt having a first pattern control surface and a second pattern control surface therearound adapted to be followed, respectively, be said first cam follower means and second cam follower means whereby long cycle stitch patterns can be generated by the extended stitch width and stitch length control of the extended first and second pattern control surfaces of said cam belt.

17. The drop-in pattern stitch assembly of claim 16 wherein said first and second pattern control surfaces of said cam belt are formed, respectively, and the top edge and the bottom edge thereof.

18. The drop-in pattern stitch assembly of claim 17 wherein said first and second cam discs and said cam belt are interchangeable.

19. A method for upgrading a basic straight stitch sewing machine comprised of a machine frame having a top portion and a base portion, a horizontal drive shaft having a forward end and a rearward end extending through the top portion of said machine frame, a drive motor for rotating said horizontal drive shaft, a needle bar and a needle bar reciprocating mechanism actuated by said horizontal drive shaft, a needle plate beneath said needle bar, a feed rock unit beneath said needle plate to longitudinally move material placed thereon, a feed rock drive assembly including a feed rock oscillating shaft extending through the base of said machine frame, a cam actuated feed fork for rotating said feed rock oscillating shaft from said horizontal drive shaft, and a feed fork regulator disposed beneath the rearward end of said horizontal drive shaft for adjusting the drive action to said feed fork for, in turn, adjusting the movement of said feed rock unit, said method comprised of the steps of for stitch width control, installing a first drop-in cam drive sub-assembly in the top portion of said machine frame proximate the forward end of said horizontal drive shaft for regulating the lateral motion of said needle bar, wherein said first drop-in cam drive sub-assembly includes a first rotatable cam means having a pattern control surface thereon which is rotatably driven from the forward end of said horizontal drive shaft, and wherein a first cam follower means disposed in the top portion of said machine frame to follow the pattern surface of said first cam means regulates the lateral motion of said needle bar in correspondence therewith, and for stitch length control, installing a separate second drop-in cam drive sub-assembly in the top portion of said machine frame proximate the rearward end of said horizontal drive shaft for separately regulating the longitudinal motion of said needle bar, wherein said second drop-in cam drive sub-assembly includes a second rotatable cam means having a pattern surface thereon which is rotatably driven from the rearward end of said horizontal shaft, and wherein a second cam follower means forming part of said second drop-in cam drive sub-assembly follows the pattern surface of said second cam means and controls said feed fork regulator in correspondence therewith for, in turn, regulating the longitudinal action of said feed rock unit.

20. The method of claim 19 wherein said first step of installing a first drop-in cam drive sub-assembly for providing stitch width control is further comprised of the steps of installing a split cam on the forward end of said horizontal shaft for generating a simple zig-zag pattern, and removing said split cam and, in place thereof, installing a drop-in cam drive sub-assembly having an interchangeable cam disc for generating more complex stitch width patterns.

* * * * *